United States Patent [19]

Kosuda et al.

[11] 4,100,902

[45] Jul. 18, 1978

[54] FUEL INJECTION SYSTEMS FOR INTERNAL COMBUSTION ENGINES OF SPARK IGNITION TYPE

[75] Inventors: Tooru Kosuda, Okazaki; Michihiro Ohashi, Handa; Eiji Tanaka, Anjo; Hiroshi Mochizuki, Okazaki; Seikou Abe, Nishio, all of Japan

[73] Assignee: Nippon Soken, Inc., Nishio, Japan

[21] Appl. No.: 750,192

[22] Filed: Dec. 13, 1976

[30] Foreign Application Priority Data

Dec. 16, 1975 [JP] Japan ..... 50/150380

[51] Int. Cl.[2] ..... F02M 39/00

[52] U.S. Cl. ..... 123/139 BC; 123/139 AW

[58] Field of Search ..... 123/139 BC, 139 AW; 417/273

[56] References Cited

U.S. PATENT DOCUMENTS

| | | | |
|---|---|---|---|
| 2,393,175 | 1/1946 | Laskey | 417/273 |
| 2,925,075 | 2/1960 | Mueller et al. | 123/139 AW |
| 3,885,387 | 5/1975 | Simington | 123/DIG. 7 |
| 3,934,561 | 1/1976 | Romann et al. | 123/139 AW |
| 3,983,849 | 10/1976 | Stumpp | 123/139 AW |
| 3,996,910 | 12/1976 | Noguchi et al. | 123/139 BC |

FOREIGN PATENT DOCUMENTS

| | | | |
|---|---|---|---|
| 113,163 | 2/1918 | United Kingdom | 123/139 BC |

*Primary Examiner*—Charles J. Myhre
*Assistant Examiner*—R. A. Nelli
*Attorney, Agent, or Firm*—Cushman, Darby & Cushman

[57] ABSTRACT

A fuel injection system for internal combustion engine of the spark ignition type is provided with a fuel metering apparatus including a fuel flow control orifice having an opening area or flow section which is varied in dependence upon a flow rate of intake air inducted into the engine. A fuel metered through the fuel metering apparatus is distributed by a distributing plate driven synchronously with the rate of revolutions of the engine at a predetermined rate and supplied intermittently and sequentially to individual cylinders of the engine through associated fuel injection valves by means of a pressure feeding apparatus such as plungers which are provided in number equal to that of the cylinder and driven synchronously with the revolution of the internal combustion engine.

14 Claims, 4 Drawing Figures

F I G. I

FUEL INJECTION SYSTEMS FOR INTERNAL COMBUSTION ENGINES OF SPARK IGNITION TYPE

BACKGROUND OF THE INVENTION

The present invention relates to a fuel injection system for injecting the fuel into an internal combustion engine of the spark ignition type.

There have been developed heretofore many and various types of fuel injection systems for the internal combustion engines of a spark ignition type. One type of the generally employed fuel injection systems is provided with a fuel metering device for metering a continuously flowing fuel, depending upon intake flow rates of air inducted into the engine, and a fuel through the fuel metering device is sequentially injected through fuel injection nozzles attached to the intake pipe or duct of the engine. In a fuel metering device proposed heretofore, a variable orifice is located in a fuel passage and operatively coupled to a sensor for detecting an intake air flow rates inducted into the engine. In addition, the fuel metering device comprises a differential pressure regulating valve for maintaining constant the difference in pressure across the variable control orifice. In this manner, the variable orifice precisely controls a flow rate of a fuel which flows continuously through a fuel passage.

In another known type of the fuel injection system, a fuel is metered by a Jerk type fuel injection pump provided with a solid cam control device which is actuated in response to rotational speeds of the engine and depending upon the degree of opening of a throttle valve, whereby a fuel-air ratio is controlled. A fuel metered is intermittently injected through a fuel injection nozzle into each cylinder of the engine.

The hitherto known fuel injection systems however suffer from various drawbacks. For example, in the case of the first mentioned type of the fuel injection system, unburnt fuel will flow out from an exhaust port to increase the content of HC in an exhaust gas when the air intake valve is opened simultaneously with the exhaust valve as is common in the internal combustion engine of the spark ignition type, since a fuel is continuously supplied to the injection valves of the individual cylinders from the fuel control apparatus during engine operation. On the other hand, the last mentioned injection pump of the Jerk type has an advantage that a fuel can be effectively atomized due to the fuel injection effected at a high pressure. However, since control of a fuel flow rate injected into the engine is carried out indirectly by detecting a rotational speed of the engine and opening of the throttle instead of detecting directly a flow rate of intake air, a fuel-air ratio will be undesirably degraded when the flow rate of intake air is varied due to the dimensional errors or tolerance of the mechanical connecting portion or abrasion in the engine. In addition, in the case of the multi-cylinder engine, a Jerk type injection pump requires the same number of elements as that of the cylinders in the engine, which involves complicated structure of the fuel injection system. Further, many components of the injection pump require a high precision working which is necessarily accompanied with high cost. Moreover, the large and heavy structure of this injection pump makes difficult the installment thereof onto a vehicle

SUMMARY OF THE INVENTION

An object of the invention is to provide a fuel injection apparatus for an internal combustion engine of the spark ignition type which avoids the drawbacks of the hitherto known fuel injection systems.

Another object of the invention is to provide a fuel injection apparatus which is capable of supplying fuel intermittently into a spark ignition type internal combustion engine with high accuracy in dependence upon a flow rate of intake air inducted into the engine.

Still another object of the invention is to provide a fuel injection apparatus of an inexpensive and simplified structure which can be conveniently installed on a vehicle.

With above objects in view, a fuel injection system for a spark ignition type internal combustion engine according to the invention is provided with a fuel metering apparatus which includes a fuel flow control orifice having an opening area or flow section variable in dependence upon a flow rate of intake air. The fuel metering apparatus continuously meters a fuel so as to control its flow rate. A fuel metered is distributed by a distributing means driven synchronously with the rotation of the internal combustion engine and supplied intermittently and sequentially to individual cylinders of the internal combustion engine through associated fuel injection valves by means of a pressure feeding means which may comprise plungers equal in number to the cylinders and which is driven synchronously with the revolutions of the internal combustion engine.

The above and other objects, novel features and advantages of the invention will become more apparent from the detailed description of the preferred embodiments of the invention taken in conjunction with the accompanying drawings.

DESCRIPTION OF THE PREFERRED EMBODIMENTS

Now, the invention will be described in detail in conjunction with the preferred embodiments thereof.

Figure 1:
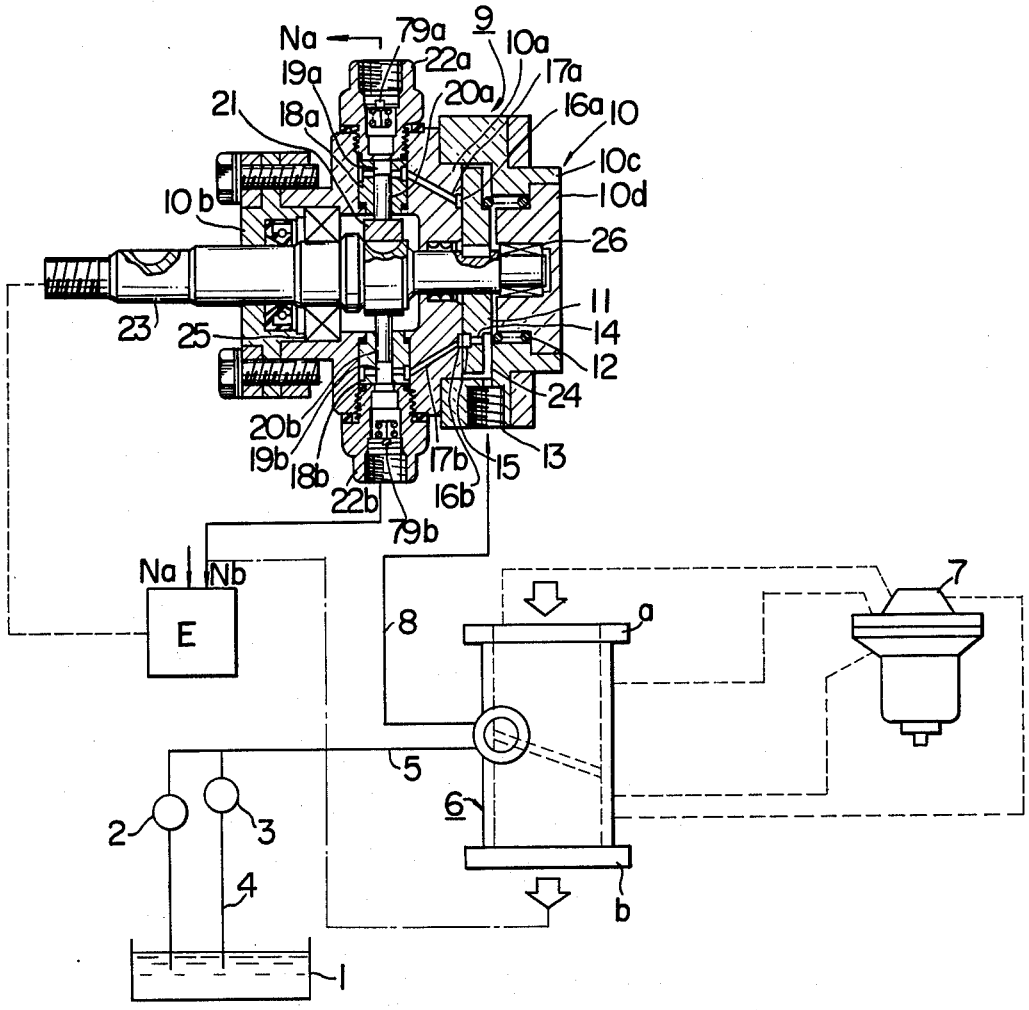
FIG. 1 illustrates schematically the general arrangement of a fuel injection system according to an embodiment of the invention with a fuel distribution and pressure-feed apparatus of the system shown in a vertical sectional view.

Referring to the drawings and in particular to FIG. 1, the illustrated fuel feed system for an internal combustion engine of the spark ignition type comprises a fuel tank or container 1, a fuel pump 2 for pumping up a fuel from the container 1 under pressure, a regulator 3 for regulating a fuel pressure at a predetermined constant value, and a bypass conduit 4 for returning a fuel flow in excess to the container or tank 1. A fuel is controlled through the regulator 3 and then supplied through a conduit 5 to a fuel metering device 6 including a differential pressure regulating valve 7 for producing a constant differential pressure across a sensor valve for intake or suction air. A fuel metered by the fuel metering device 6 is then fed to a fuel distribution and pressure-feed apparatus 9 through a conduit or pipe line 8.

The fuel distribution and pressure-feed apparatus 9 serves for fuel distribution and fuel pressure-feeding to the individual cylinders (not shown) of an internal combustion engine E. In more detail, the apparatus 9 includes a housing 10 composed of a main block 10*a*, a left cover portion 10*b*, and a first right cover portion 10*c* and a second right cover portion 10*d* which are secured together by suitable means such as bolts. A distribution plate or disk 11 which constitutes an important part of the fuel distribution apparatus is rotatably disposed in an inner space defined by the enclosing portions 10*a*, 10*c* and 10*d* of the housing 10 and pressed against the confronting wall of the housing main block 10*a* by means of a compression spring 12. The distribution plate 11 is formed with a distributing port 15 opened at the left side thereof as viewed in the drawing and a communication passage 14 for connecting the distributing port 15 to a distributing chamber 24 which is constantly communicated with a fuel inlet port 13 provided in the first right cover portion 10*c* of the housing. Fuel receiving ports 16*a* and 16*b* are formed in the main block 10*a* of the housing at the right side wall thereof in number equal to that of the cylinders of the engine E. In the illustrated embodiment, it is assumed that the engine E has two cylinders. The fuel receiving ports 16*a* and 16*b* are positioned with an equal angular distance therebetween so as to be radially aligned with the distributing port 15 formed in the distribution plate 11. It will be appreciated that the distributing port 15 of the distribution plate 11 will sequentially communicate with the fuel receiving ports 16*a* and 16*b* without interruption, as the distribution plate 11 is rotated.

Cylinders 18*a* and 18*b* the number of which is in correspondence with the number of the cylinders of the engine are provided in the main block 10*a* of the housing 10. The cylinders define plunger chambers 19*a* and 19*b*, respectively, which are communicated with the fuel receiving ports 16*a* and 16*b*, respectively, through associated passages 17*a* and 17*b*. Further, the plunger chambers 19*a* and 19*b* communicated with connector portions 22*a* and 22*b* respectively, through associated discharge valves 79*a* and 79*b*, respectively, and thence to respective fuel injection valves N*a* and N*b* of the engine E. It will be seen that plungers 20*a* and 20*b* are slidably disposed within the cylinders 18*a* and 18*b*, respectively.

A drive shaft 23 extends through the housing 10 at the center portion thereof and is rotatably supported by bearings 25 and 26 which are mounted on the main block portion 10*a* and the second right cover portion 10*d*, respectively, of the housing 10. The distribution plate or disk 11 described above is fixedly secured to the drive shaft 23 at the center thereof so as to be rotated simultaneously with the shaft 23. The drive shaft 23 is rotated by the internal combustion engine E through a gear train or belt-drive means in such a manner that the ratio of rotation of the drive shaft 23 to that of the crank shaft (not shown) of the engine E is 1 to 1 in the case of two cycle engine and 1 to 2 in the case of four cycle engines. A cam 21 is fixed to the drive shaft 23 and bears against the inner ends of the plungers 20*a* and 20*b*. It will be appreciated that the plungers 20*a* and 20*b* are sequentially moved outwardly through the rotation of the cam 21. The timing at which each of the plungers 20*a* and 20*b* is pushed outwardly under the action of the cam 21 is so determined that, after the distributing port 15 of the distribution plate 11 is aligned and communicated with one of the receiving ports 16*a* or 16*b*, the distributing port 15 has just passed by the aligned receiving port 16*a* or 16*b*.

Figure 2:
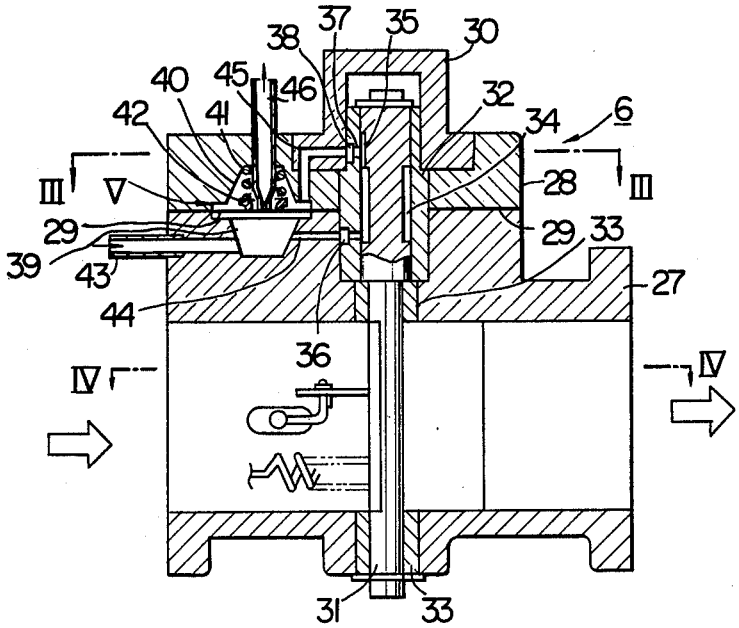
FIG. 2 is a longitudinal sectional view of a fuel metering apparatus shown schematically in FIG. 1.
Figure 3:
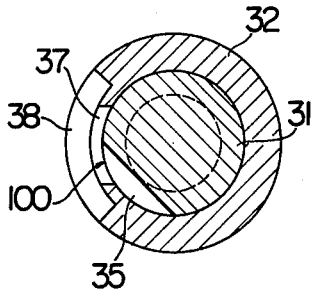
FIG. 3 is an enlarged sectional view of the same taken along the line III — III in FIG. 2.

The fuel metering device 6 serves to meter or adjust the continuous flow of the fuel supplied through the conduit 5 in dependence upon a flow rate of intake air induced into the engine E and to continuously deliver the thus metered fuel to a conduit 8. In more detail, reference is made to FIGS. 2 and 3. The fuel metering device 6 comprises an air conduit 27 of a rectangular inner or flow cross section, a housing 28 combined with the air conduit 27, a metal diaphragm 29 sandwiched between the air conduit 27 and the housing member 28, and a cover 30 secured to the housing 28. A sensor valve stem or shaft 31 is fitted smoothly and rotatably within a metering cylinder 32 fixedly secured in common to the air conduit 27 and the housing 28, and is supported by a sensor valve stem bearing 33. An annular groove is formed on the outer surface of the sensor valve stem or shaft 31 in its upper portion inserted in the metering cylinder 32 so as to form a fuel passage chamber 34 with the inner surface of the cylinder 32. Additionally formed on the outer surface of the sensor valve stem 31 is a cut-out flat portion or notch 35 which is communicated with the passage 34. On the other hand, the fuel metering cylinder 32 is formed with a fuel supply port 36 so as to be communicated with the fuel passage chamber 34, a slit 37 engageable with the notch 35 and a fuel discharge port 38 communicated with the slit 37. The slit 37 vertically extends with a narrow axial width. The notch or cut-out portion 35 formed in the sensor valve stem 31 cooperates with the slit 37 formed on the metering cylinder 32 to constitute a control orifice 100 (FIG. 3).

The metal diaphragm 29 defines lower and upper differential pressure chambers 39 and 40 formed in the walls of air duct 27 and the housing 28, respectively. A return spring 41 is disposed within the upper chamber 40 so as to rest on a spring seats 42. The partitioned chambers 39 and 40, the diaphragm 29 and the return spring 41 constitute a differential pressure regulating valve V for regulating a fuel pressure differential across the control orifice 100. The spring seat 42 is mounted on the metal diaphragm 29 in the upper chamber and the return spring 41 applies a load to urge the diaphragm 29 toward the lower chamber. The fuel is supplied to the lower chamber 39 from a fuel inlet port 43 which is additionally communicated with the supply port 36 formed in the metering cylinder 32 through a fuel supply passage 44. On the other hand, the fuel discharge port 38 formed in the metering bearing 32 is communicated with the upper chamber 40 of the valve assembly V. A fuel exit pipe 46 is disposed within the upper chamber 40 with its lower open end abutting on the metal diaphragm 29. The fuel inlet port 43 and the fuel exit pipe 46 are connected to the conduits 5 and 8 (FIG. 1), respectively.

Figure 4:
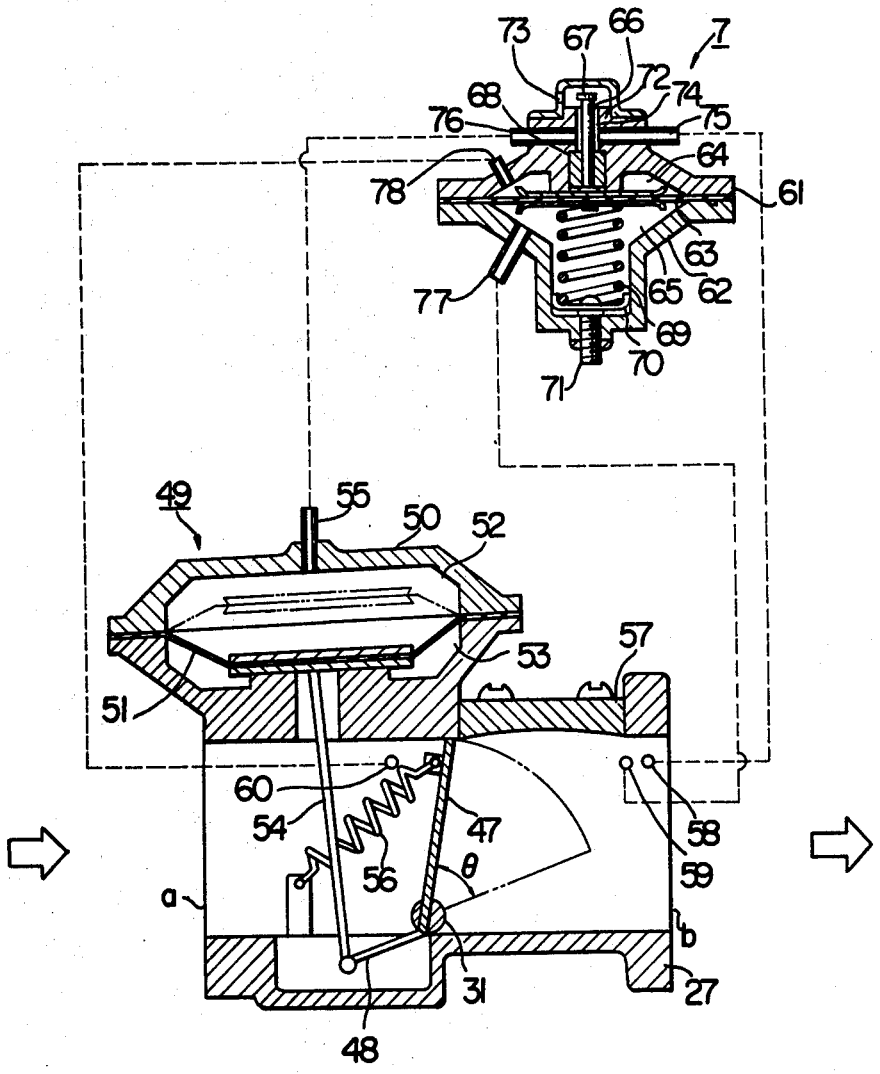
FIG. 4 shows the apparatus of FIG. 2 in an enlarged sectional view taken along the line IV — IV in FIG. 2 and additionally shows in section a differential pressure regulator valve shown in FIG. 1.

Referring to FIG. 4, a sensor valve 47 is fixedly secured to the valve stem or shaft 31 which is also provided with a fixed arm 48. A pressure responding apparatus 49 is provided which is composed of a housing 50, a diaphragm 51 forming an upper chamber with the housing 50 and a similar lower chamber 53 with the air conduit 27, and a connecting rod 54 for connecting the diaphragm 51 with the angle arm 48 to apply a rotational force to the sensor valve 47. A negative pressure inlet port 55 is fixed to the housing 50 so as to be communicated with the upper chamber 56. A return spring 52 is hung on the sensor valve 47. At its one end, the return spring 56 biases the sensor valve 47 toward the closed position thereof. A correcting plate 57 is fixed to the air duct 27 at a side opposite to the foot portion of the sensor valve 47 and serves to correct linearly the sectional area of an intake air flow depending on the rotational angle of the sensor valve stem 31. To this end, the correcting plate 57 is formed with a smooth concave surface. Negative pressure outlets 58 and 59 are opened at the downstream side of the sensor valve 47, while a negative pressure outlet port 60 is opened at the upstream side of the sensor valve 47.

The differential pressure regulator valve 7 for intake air includes a first and a second housing blocks 61 and 62 between which a diaphragm 63 is clamped at the periphery thereof to form, a first and a second negative pressure chambers 64 and 65 with the first and second housing blocks 61 and 62, respectively. A slidable shaft 66 having a control valve element 67 fixed at its one end is secured to the diaphragm 63 at the other end thereof and supported slidably by a bearing 68. As shown in FIG. 4, a return spring 69 is so arranged within the housing block 62 as to bias the diaphragm 63 upwardly. The load of the return spring 69 is adjustable by an adjusting screw 71 through a spring seat 70. A flat valve seat 72 for receiving the control valve element 67, is formed in the top portion of the housing block 61. An air port 73 is communicated with an air inlet passage 74 defined between the bore of the flat valve seat 72 and the peripheral surface of the slidable shaft 66. A negative pressure inlet port 75 is communicated with the negative pressure outlet port 58, and a negative pressure outlet port 76 is communicated with the negative pressure inlet port 55. A negative pressure inlet port 77 is communicated with the negative pressure outlet port 59, and a negative pressure outlet port 78 is communicated with the negative pressure outlet port 60, as shown in FIG. 4.

Now, the operations of the above-mentioned system will be hereinbelow described.

When the spark ignition type internal combustion engine E is started, intake air from an air cleaner (not shown) will flow through the air duct 27 of the fuel metering device 6 from the upstream side *a* to the downstream side *b* as indicated by arrows, and into an intake or suction duct (not shown) of the engine E. As intake air flows through the air conduit 27, the sensor valve stem or shaft 31 is caused to rotate against the return spring 56, depending upon the flow rate of intake air flow. Such rotation of the sensor valve stem 31 is brought about under the concurrent influence of the aerodynamic force applied to the sensor valve 47 and the force of the negative pressure which is applied to the upper surface of the diaphragm 51 of the pressure responsive apparatus 49 and which is derived from the negative pressure inlet port 58 through the differential pressure regulator valve 7. In this connection, it is to be noted that the latter force is transmitted through the connecting rod 54. The pressures upstream and downstream of the sensor valve element 47 are transmitted from the negative pressure outlet ports 60 and 59 to the first and second negative pressure chambers 64 and 65, respectively, of the differential pressure regulating valve 7 for intake air. The slidable shaft 66 of the differential pressure regulator valve 7 is displaced in response to the difference between the pressures prevailing within the upper chamber 64 and the lower chamber 65 as well as the biasing force of the spring 69. Upon the displacement of the shaft 66, an air passage of a variable flow section is formed between the control valve element 67 and the valve seat 72 of the valve 7, which gives rise to air flow from the air inlet port 73 thereby to reduce the negative pressure applied to the upper surface of the diaphragm 51 of the pressure responding apparatus 49. The sensor valve element 47 is thus actuated in the closing direction. Such operation described above takes place over the whole range of intake air flow rates. It will thus be appreciated that the differential pressure regulating valve 7 constantly serves to maintain constant the pressure difference across the sensor valve 47. On the other hand, the flow area of intake air produced between the sensor valve element 47 and the correcting plate 57 will vary in a linear relation to the rotational angle $\theta$ of the sensor valve shaft 31, because the correcting plate 57 is formed with a smooth concave surface which is so contoured as to vary the flow area linearly relative to the rotational movement of the sensor valve 47. Accordingly, assuming that variations in flow coefficients of the air conduit 27 is negligible, the rotational angle $\theta$ of the sensor valve stem 31 may be considered to vary linearly as a function of the air flow in the air conduit 27.

Next, description will be made concerning fuel flow in the system. A fuel pumped up from the fuel tank or container 1 by means of the fuel pump 2 continuously flows into the conduit 5 while maintained at a constant hydraulic pressure through the regulator 3. An excess of fuel is returned to the fuel tank 1 through the bypass conduit 4. The fuel in the conduit 5 will flow into the lower chamber 39 of the differential pressure regulator valve V through the fuel supply port 43 of the fuel metering apparatus 6 and exert hydraulic pressure to the lower surface of the diaphragm 29. The fuel flows through the supply passage 44, the fuel supply port 36 and the passage chamber 34 to the notched portion 35 formed in the upper portion of the sensor valve stem 31. The fuel is then metered by the control orifice 100 which is variable in opening area as a function sin $\theta/2$ (wherein $\theta$ is rotational angle of the sensor valve stem 31) relative to the parallel slit 37. The metered fuel flows subsequently through the fuel discharge port 38 and the fuel passage 45 into the upper chamber 40 of the differential pressure regulator valve V to apply a pressure to the metal diaphragm 29 and thence flows through the conduit 8 (FIG. 1) from the fuel exit 46 into the fuel receiving port 13 of the fuel distribution and pressure feed apparatus 9. At that time, the fuel flow area between the lower open end of the fuel exit conduit 46 and the diaphragm 29 in the upper chamber 40 of the differential pressure regulating valve V is varied so that the pressure difference across the metal diaphragm 29 is balanced by the force of the return spring 41.

It will be understood from the foregoing description that the rotational angle $\theta$ of the sensor valve shaft 31 will vary linearly in dependence upon an intake air flow rate, while an aperture or opening area of the control orifice 100 formed by the notch 35 of the sensor valve stem or shaft 31 and the parallel slit 37 of the metering bearing 32 is varied as the function sin $\theta/2$ of the rotational angle $\theta$ of the sensor valve shaft 31. Since the differential pressure across the control orifice 100 is maintained constant as described hereinbefore, the fuel flow rate may vary with $\theta$ as the function of sin $\theta/2$. When $\theta$ is in small range, it is safely said that the fuel flow rate may change with $\theta$ as the function of $\theta/2$. Thus, the flow rate is in proportion to $\theta$, when $\theta$ is small. In this manner, the fuel flow may be metered substantially linearly relative to an air intake flow rate.

The fuel metered through the fuel metering device 6 will then flow into the distribution chamber 24 from the fuel receiving port 13 of the fuel distribution and pressure feed apparatus 9 and thence into the distributing port 15 through the passage 14. The fuel received in the distributing port 15 is alternately transferred to one of the receiving ports 16*a* and 16*b* formed in the housing block 10*a* which has aligned with the distributing port 15 during the rotation of the distributing plate 11. The fuel thus distributed is then fed into the associated plunger chamber 19*a* or 19*b* through the respective passage 17*a* or 17*b*. The fuel in the plunger chamber is prevented from flowing outwardly into the associated nozzle N*a* or N*b* due to the action of the installed discharge valve 79*a* or 79*b*, whereby the associated plunger 20*a* or 20*b* is urged to bear on the periphery of the cam 21. The displacement of the plunger corresponds to the fuel flow as distributed. When the distributing port 15 of the distributing plate 11 has passed by the aligned port 16*a* or 16*b*, the plunger abutting against the cam 21 is pushed outwardly by the cam 21 which is fixedly secured to the rotating drive shaft 23. Since the receiving port 16*a* or 16*b* which is communicated with the plunger chamber is now closed, the increased pressure of fuel in the plunger chamber will cause the associated discharge valve to be opened, thereby to allow the fuel to flow into the associated nozzle N*a* or N*b* of the internal combustion engine. As hereinbefore described, the distribution plate 11 is connected to the drive shaft 23 which is rotated twice for two revolutions of the internal combustion engine E of two cycle type and rotated once for each revolution of the two cycle engine E. In this manner, it is assured that the fuel injection is effected to the individual cylinders of the engine E at the appropriate strokes. The fuel injection is made intermittently for each of the individual cylinder.

In the above described embodiment, the distribution of a fuel which is metered by the fuel metering apparatus to the individual plunger chambers is accomplished by the distribution plate or disk 11 having the distributing port 15 and being rotated with the drive shaft 23. However, it should be appreciated that the invention is never restricted to such arrangement, but any other fuel distribution arrangements can be adopted, so far as the time interval between the fuel distributions to the different plunger chambers is maintained constant, the flow resistance of the fuel receiving port is not greatly different from those of the plunger chambers, the receiving orifice communicating with the plunger chamber in which the plunger is being pushed up by the cam is closed at that time, and the fuel distribution takes place constantly to at least one plunger chamber so that the fuel flow is maintained continuously without being interrupted by the fuel distribution.

As will be appreciated from the foregoing description, according to the invention, a continuous flow of the fuel is metered by the control orifice having an opening variable in dependence upon the intake flow rate of air inducted to the engine and the metered fuel is intermittently pressure-fed to the individual fuel injection valves of the individual cylinders of the engine E through the actuation of the plungers. The apparatus according to the invention thus permits the metering of fuel at a high accuracy with a relatively simplified structure and allows the intermittent fuel injection which is advantageously effective for the operation of the spark ignition type internal combustion engines. Further, since the metering device and the distribution and pressure feed apparatus can be provided separately and connected together, the installation of the whole system on vehicle can be easily accomplished in a simplified manner.

We claim:

1. A fuel injection system for an internal combustion engine of spark ignition type comprising:

a fuel metering means for controllably metering a continuous flow of fuel fed to said internal combustion engine in dependence upon flow rate of intake air inducted to said engine;

a fuel distributing device comprising a plurality of fuel receiving ports provided in number equal to that of the cylinders of said engine and a fuel distributing means adapted to sequentially communicate with said fuel receiving ports as driven by said engine thereby to distribute the metered fuel received from said fuel metering means to said receiving ports;

a fuel pressure-feeding means comprising a plurality of chambers equal in number to the cylinders of said engine and each communicated with each of said fuel receiving ports, fuel pressure-feeding members watch reciprocally accommodated within each of said chambers, driving means for driving said fuel-feeding members at predetermined cycle to perform the reciprocal movements within said chambers depending upon the revolution number of said engine, and discharge valves each connected to each of said chambers, said discharge valves being opened when a pressure in said chambers exceeds a predetermined level, thereby to pressure feed intermittently said distributed fuel from said fuel distributing means in accordance with said reciprocal movements of said pressure-feeding members; and fuel injection valve means provided in number equal to that of the cylinders of said engine and communicated with said chambers of said pressure-feeding means to receive intermittently supplied fuel thereby to feed the received fuel into the associated cylinders of said engine.

2. A fuel injection system as set forth in claim 1, wherein said fuel metering means comprises a control orifice for the continuous fuel flow, the opening of said orifice being varied in dependence upon the flow rate of air inducted to said engine.

3. A fuel injection system as set forth in claim 2, wherein said opening of said fuel flow control orifice is controlled in respect of flow area thereof in dependence upon angular position of a valve element disposed in the air intake conduit.

4. A fuel injection system as set forth in claim 3, wherein said fuel flow control orifice is formed by a notch formed in a rotatable shaft to which said valve element is secured and a slit formed in a stationary bearing member for rotatably supporting said shaft, said notch being communicated with a supply source of said fuel and angularly displaceable relative to said slit.

5. A fuel injection system as set forth in claim 4, further comprising a fuel pressure control means communicated with said slit formed in said bearing for feeding the fuel flow metered by said control orifice at a regulated pressure.

6. A fuel injection system as set forth in claim 4, wherein said air intake conduit has a rectangular flow section, and said valve element is composed of a plate having a correspondingly rectangular shape and swingable in dependence upon differential pressure across said valve element in said air intake conduit.

7. A fuel injection system as set forth in claim 6, wherein said opening or flow area of said control orifice is varied as a function sin $\theta/2$ of said angular displacement $\theta$ of said valve element about said shaft to which said valve element is fixedly secured.

8. A fuel injection system as set forth in claim 1, wherein said fuel distributing means comprises a disc which is accommodated within a chamber communicated with a port for receiving the metered fuel from said fuel metering means and adapted to be rotated by a drive shaft which in turn is driven by said engine at a predetermined rotational speed, and an opening port formed through said disc.

9. A fuel injection system as set forth in claim 8, wherein said fuel receiving ports are formed in a stationary block having a wall slidably engaged with said disk at such locations that said fuel receiving ports are individually and sequentially communicated with said port upon rotation of said distributing disc.

10. A fuel injection system as set forth in claim 1, wherein said fuel pressure-feeding members each comprises a plunger reciprocally disposed within the associated plunger chamber communicated with the associated fuel receiving port, and wherein said driving means comprises a driving shaft rotatable at a predetermined rotational rate relative to revolution number of said engine and a cam secured to said driving shaft on which said plungers abut at ends thereof.

11. A fuel injection system as set forth in claim 10, wherein said cam is so contoured that each said plungers is actuated by said cam to pressure-feed the distributed fuel from said plunger chamber to the associated one of said fuel injection valves only when said plunger chamber is not in communication with said distributing port of said distributing plate through said fuel receiving port.

12. A fuel injection system as set forth in claim 11, wherein a discharge valve is disposed in each of said plunger chambers, said discharge valve being adapted to open at a predetermined pressure of the fuel within said plunger chamber attained by the actuation of said plunger.

13. A fuel injection system for a multi-cylinder internal combustion engine comprising:

fuel supply means for supplying fuel continuously;

fuel metering means hydraulically communicated with said fuel supply means for controlling the flow rate of continuous fuel flow from said fuel supply means in dependence upon the flow rate of intake air inducted into said engine;

fuel distribution means hydraulically communicated with said fuel metering means, said fuel distribution means including a fixed member having a plurality of fuel receiving ports equal in number to the cylinders of said engine, and a rotatable distributing member driven by said engine and having at least one fuel distributing port supplied with the metered fuel from said fuel metering means, said fuel distributing port being adapted to sequentially communicate with said fuel receiving ports with the rotation of said distributing member thereby to distribute the fuel to said fuel receiving ports;

fuel feeding means including a plurality of chambers equal in number to the cylinders of said engine and each communicated with each of said fuel receiving ports, fuel pressurizing members each accommodated within each of said chambers, and driving means operatively connected to said fuel pressurizing members for driving the same at a predetermined cycle depending upon the revolution of said engine;

each of said fuel pressurizing members pressurizing the distributed fuel supplied in each of said chambers from each of said fuel receiving ports and feeding the pressurized fuel intermittently; and fuel injection valve means, provided in number equal to that of the cylinders of said engine and each communicated with each of said chambers of said fuel feed means, for injecting the fuel intermittently fed from said fuel feed means into said engine.

14. A mechanically operated fuel injection system for a multi-cylinder type internal combustion engine, comprising:

(a) fuel delivery means for regulating the pressure of fuel at a predetermined level and delivering the fuel;

(b) fuel metering device for metering the amount of the fuel flow delivered from said fuel delivery means in response to the quantity of intake air induced into the engine, said fuel metering device comprising:

(i) a housing having an intake air conduit connected to an intake pipe of the engine, (ii) a rotatable sensor valve disposed in said air conduit and having a rotating angle, the rotating angle of said sensor valve being in proportion to the quantity of intake air passing through said air conduit, (iii) a sensor valve shaft connected to said sensor valve for rotation in unison therewith, said sensor valve shaft having a cutout portion formed at a part thereof, (iv) a fuel metering cylinder disposed in said housing for rotatably supporting said sensor valve shaft, said cylinder having a slit to define a control orifice with said cutout portion of said sensor valve shaft, (v) a fuel differential pressure regulating valve for maintaining the pressure of the fuel across said control orifice substantially at a predetermined level, (vi) a fuel supply port for communicating said fuel delivery means with one side of said control orifice to supply the fuel thereto, (vii) a fuel discharge port communicated with the other side of said control orifice, and (viii) pressure-activated means operatively coupled to said sensor valve for maintaining the differential pressure across said sensor valve at a predetermined level;

(c) fuel distributing means comprising:

(i) a housing having a fuel inlet port connected to said fuel discharge port of said fuel metering device, (ii) a plurality of fuel receiving ports equal in number to the cylinders of the engine, and (iii) a distribution plate rotatably disposed in said housing and operatively coupled to the engine for rotation in synchronism with the rotation of the engine, said distribution plate having a distribution port for sequentially communcating said fuel inlet port with one of said fuel receiving ports in accordance with the rotation of said distribution plate;

(d) fuel pressure-feeding means comprising:

(i) a plurality of pressure-feeding cylinders equal in number to said fuel receiving ports, (ii) plungers reciprocally disposed in each of said pressure-feeding cylinders for forming plunger chambers, each being communicated with said fuel receiving ports, (iii) driving means operatively connected to said plungers for performing the reciprocal movements in accordance with the rotations of the engine, and (iv) discharge valves respectively coupled to said pressure-feeding cylinders, to thereby feed the fuel in the plunger chambers at a regulated pressure; and (e) a plurality of fuel injection nozzles equal in number to the cylinders of the engine, each being communicated with each of said plunger chambers through the respective discharge valves, for injecting the metered and distributed fuel into the engine.

* * * * *